United States Patent [19]

McGourty et al.

[11] Patent Number: 4,544,289

[45] Date of Patent: Oct. 1, 1985

[54] PRINT DISK POSITIONING SYSTEM

[75] Inventors: Thomas K. McGourty; Lawrence F. McGourty, both of Pas Robles, Calif.

[73] Assignee: Varitronic Systems, Inc., Eden Prairie, Minn.

[21] Appl. No.: 584,434

[22] PCT Filed: Jan. 20, 1984

[86] PCT No.: PCT/US84/00095

§ 371 Date: Feb. 17, 1984

§ 102(e) Date: Feb. 17, 1984

[87] PCT Pub. No.: WO85/03255

PCT Pub. Date: Aug. 1, 1985

[51] Int. Cl.[4] ..... B41J 1/28

[52] U.S. Cl. ..... 400/154.5; 101/93.19; 400/25; 400/163

[58] Field of Search ..... 400/23, 25, 29, 134, 400/134.1, 139, 153, 154, 154.1, 154.4, 154.5, 155, 163, 275; 101/93.19

[56] References Cited

U.S. PATENT DOCUMENTS

| | | | |
|---|---|---|---|
| 752,792 | 2/1904 | Moya | 400/144.2 |
| 3,447,656 | 6/1969 | Nyquist | 400/29 |
| 3,493,091 | 2/1970 | Kapp | 400/161.1 |
| 3,794,150 | 2/1974 | Cahill et al. | 400/163 |
| 3,960,072 | 6/1976 | Ahlgren et al. | 400/140 X |
| 4,074,798 | 2/1978 | Berger | 400/144.2 |
| 4,099,106 | 7/1978 | Nikaido | 400/154.5 X |
| 4,215,943 | 8/1980 | Lau | 400/161.1 |
| 4,281,938 | 8/1981 | Phillips | 400/144.2 X |
| 4,335,940 | 6/1982 | Morgan | 354/8 |
| 4,335,941 | 6/1982 | Moyroud et al. | 354/15 |
| 4,346,445 | 8/1982 | Leuenberger | 364/520 |

FOREIGN PATENT DOCUMENTS

| | | | |
|---|---|---|---|
| 33226 | 8/1981 | European Pat. Off. | 400/144.1 |
| WO82/01513 | 5/1982 | European Pat. Off. | 400/144.2 |
| 1561261 | 2/1970 | Fed. Rep. of Germany | 400/144.2 |
| 2716067 | 11/1977 | Fed. Rep. of Germany | 400/29 |

*Primary Examiner*—Paul T. Sewell

*Attorney, Agent, or Firm*—Merchant, Gould, Smith, Edell, Welter & Schmidt

[57] ABSTRACT

A print disk positioning system is disclosed herein which provides rotational and lateral movement of a print disk (20) having raised or depressed characters thereon with the objective of locating the appropriate character within the jaws of a printing station (22). The positioner includes a fixed rail (44) which is driven by the rotation of a motor (38) having a pinion gear (42) which drives a rack gear (82) connected to a rack arm (80) which in turn slides a second motor (54) mounted on bearings (56) on rail (44). Motor (54) provides the rotational movement to the disk and motor (38) provides the lateral movement. Each motor is controlled electrically to cause an appropriate sequence of movements to bring the disk into proper alignment in the printing station at the appropriate time.

8 Claims, 6 Drawing Figures

PRINT DISK POSITIONING SYSTEM

TECHNICAL FIELD

This invention relates to the general field of printing or typing equipment wherein a printing disk with characters thereon is caused to print by impacting a printing surface. Specifically, this invention is directed to the system for positioning the print disk at the appropriate location for printing each character.

CROSS REFERENCE

This application hereby incorporates by reference the disclosures of our co-pending applications filed on even date herewith with the following titles:

Precision Tape Feed and Guide Mechanism, Ser. No. 587,184

Printing Mechanism, Ser. No. 608,050

Ribbon Cassette, Ser. No. 592,018

Tape Cassette with Supply Indicator, Ser. No. 598,554

Electronic Tape Writing Machine, Ser. No. 587,318.

BACKGROUND OF THE INVENTION

The concept of dry transfer impact printing with a print wheel is known in the art as in, for example, U.S. Pat. No. 4,074,798 issued to Burger. Its application to the printing of characters on a tape is shown in U.S. Pat. No. 3,834,507 issued to Bradshaw. A system similar to Bradshaw, but automated, is shown in PCT Publication No. WO/8203600. The system shown in Burger is effective for characters having a relative small pitch and point, such as used in typewriters. When used to create letters of varying sizes, for example, up to 36 point, simple rotation and shifting of the print wheel is insufficient to move characters of such size into alignment with the print head. In the prior art such as Bradshaw and the PCT Publication, this problem has been circumvented by merely providing a single circumferential track having letters thereon for impact printing. This system, however, becomes extremely cumbersome as the number and size of letters increases, since the print disk must be of increasing diameter, and time required to print succeeding characters thereby increases substantially.

The present invention overcomes these problems in the prior art relating to speed and size limitations, while providing an economical and simple to manufacture system for positioning the appropriate character in place for impact printing.

SUMMARY OF THE INVENTION

The invention is generally directed to a print disk positioning system for use with an impact printer, which employs a print disk having characters thereon. The positioning system includes a planar rail member with first and second ends, a first stepping motor immovably mounted adjacent to the rail and having a first shaft extending from motor, a second stepping motor mounted on the rail and in slideable engagement therewith such that it may be moved a predetermined distance between the rail ends, the second motor having a second shaft extending therefrom and sized to engage the print disk, and means connected to the second motor and engaging the first shaft of the first motor for moving the second motor along the rail in response to the print disk can be rotated by the second shaft and moved laterally by the first shaft to position the selected characters on the print disk in alignment for impacting.

According to another aspect of the invention, the planar rail member has a slot extending longitudinally to a predetermined distance between the ends of the rail and a recess on parallel longitudinal edges of the rail, which receive bearings connected to the second motor which maintain the motor in a rigid but slideable engagement with the rail. According to further aspects of the invention, the connecting means includes a rack member extending between the motors and engaging a gear on the first shaft.

According to a further aspect of the invention, the print disk positioner includes a disk having multiple concentric tracks with characters thereon spaced around each track and located relative to each other in accordance with their statistical probability of occurrence in the language, with the most probable characters being located nearest to each other, so as to minimize the time required to access successive characters.

According to a further aspect of the invention, the print disk includes coded information, and the positioner includes means for reading such information so that the nature and type of the print wheel can be identified by circuitry used in the overall printing machine.

Although some specific embodiments of the present invention have been shown, those skilled in the art will perceive modifications which can be made without parting from the spirit of the invention. Therefore, it is intended that the scope of the present invention be dictated by the appended claims rather than by the description of the embodiment.

DETAILED DESCRIPTION OF THE INVENTION

Figure 1:
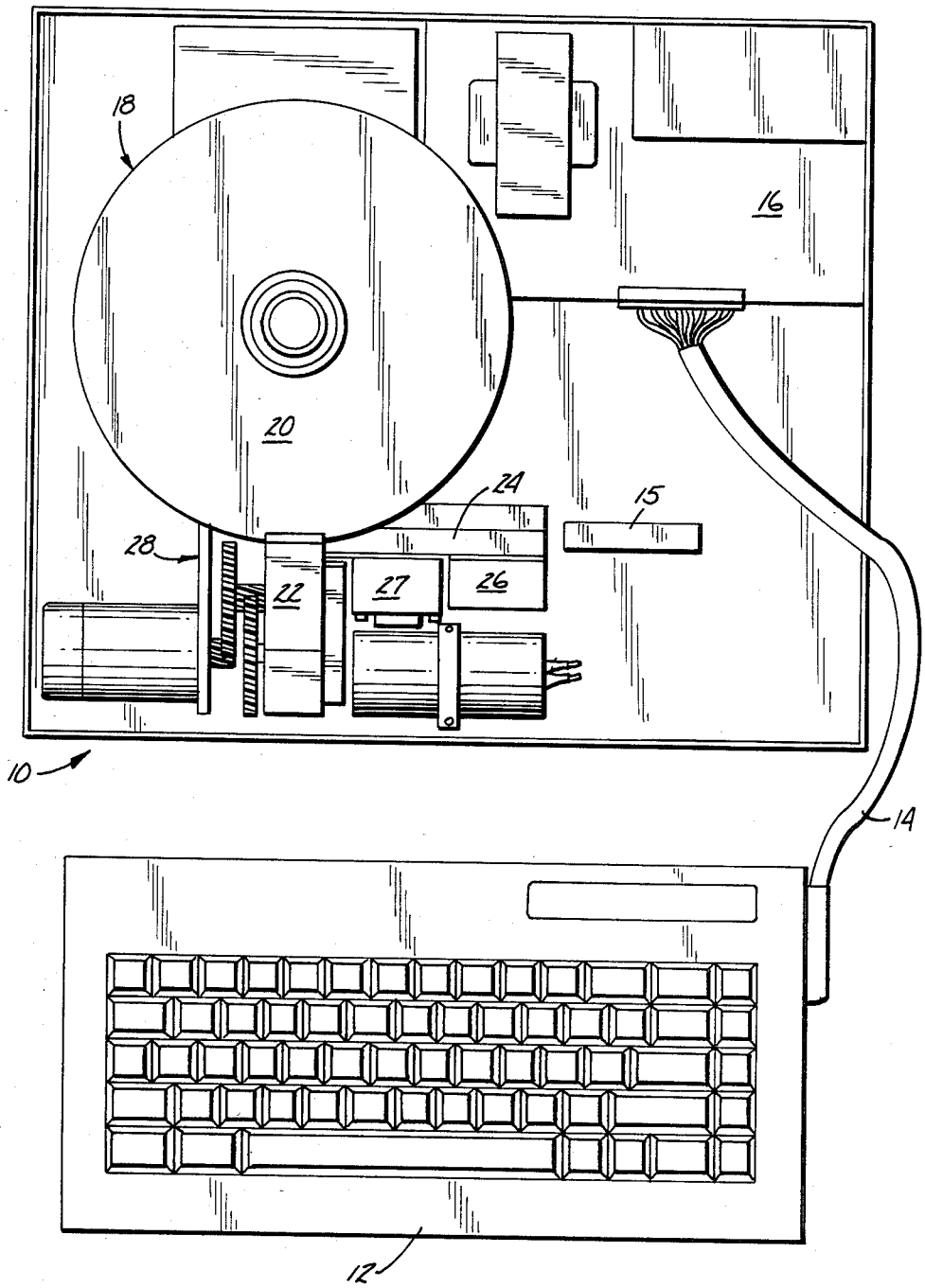
FIG. 1 is a top plan view of the environment in which this invention could be employed, namely, an electronic tape writing machine.

Reference is first made to FIG. 1 of the drawings, which shows an overall environmental view of a system in which the invention is preferably employed. FIG. 1 shows an electronic tape writing machine 10 having a keyboard 12, which is connected by a cable 14 to an electronics section 16. Signals from the keyboard are interpreted by the electronics section 16, and causes the print disk positioner 18 to locate the print disk 20 in the appropriate position within the jaws of the impact printing device 22. Adjacent to device 22 is a carrier tape 15 and carbon-like film cartridge 24 which is advanced by the tape advance device 26 and which may later be cut by the tape cutting device 28.

Figure 2:
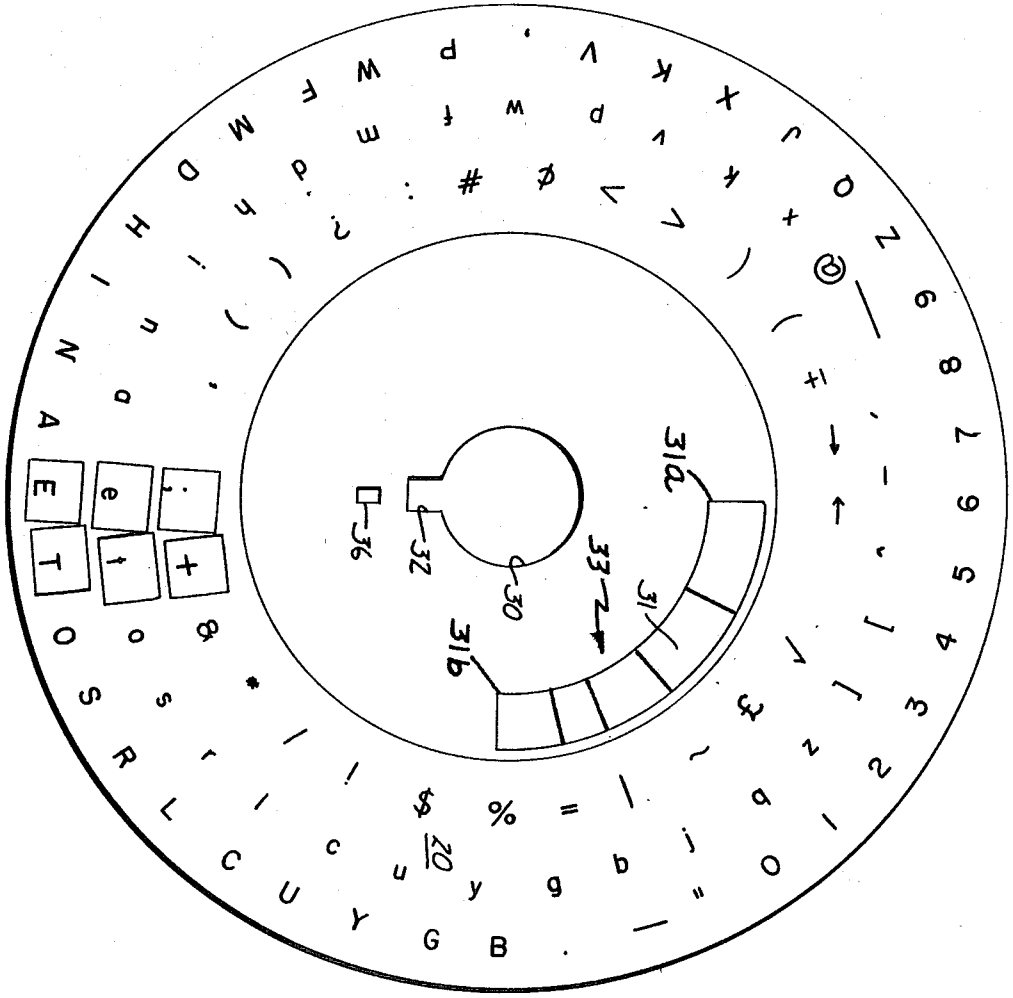
FIG. 2 is a plan view of the printing side of a print disk.

FIG. 2 illustrates a typical print disk 20 having a center hole 30 with a key way 32 and, at a predetermined radial distance from the center hole, a bar code region 31 of the type known in the art, which has bars intermittently spaced which can be optically scanned by the print disk positioner. The print disk 20 may also include an alignment hole 36.

Figure 3:
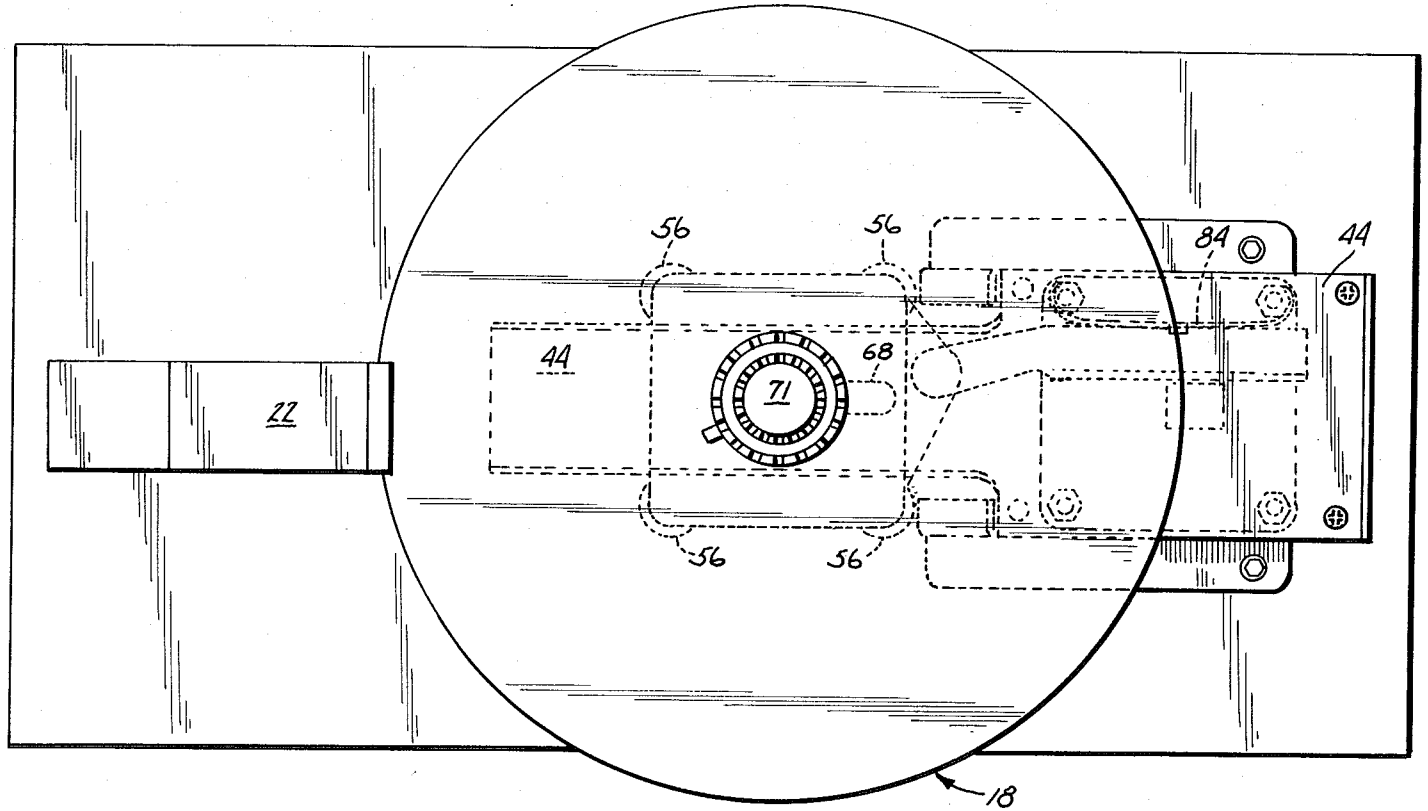
FIG. 3 is a top plan view of the print disk positioner.
Figure 4:
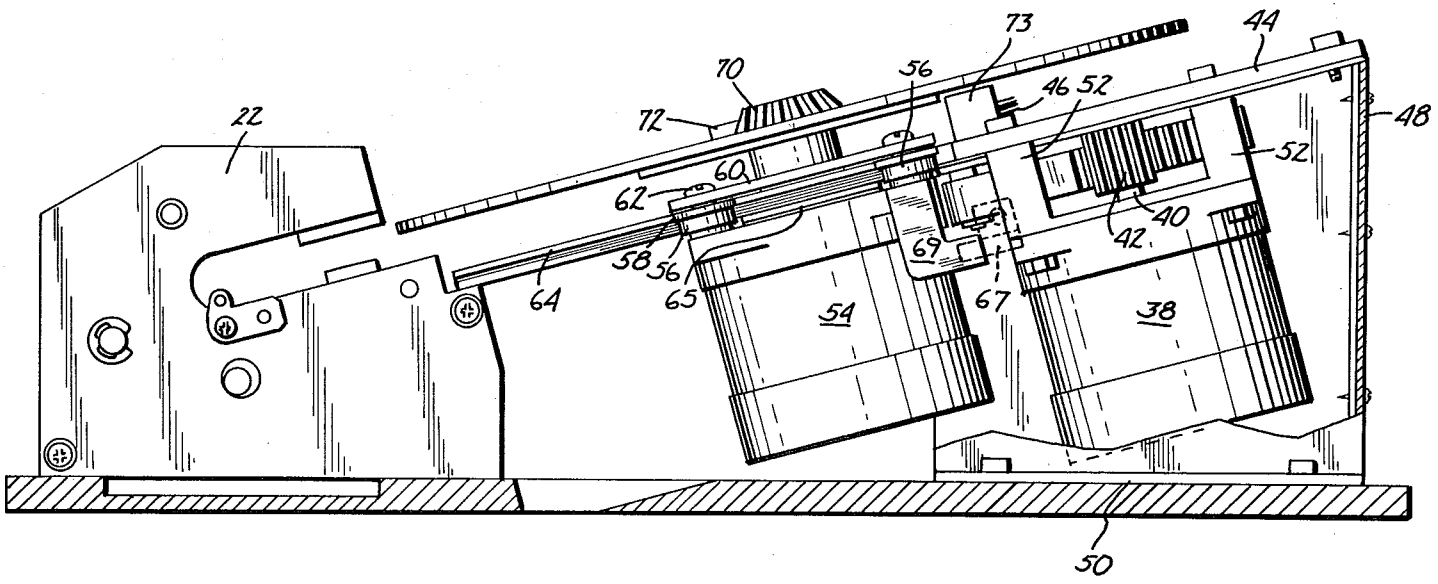
FIG. 4 is a side view of FIG. 3 with the base shown in section.

FIG. 3 illustrates the print disk positioner 18 with a print disk 20 in place and shown just before engagement with the jaws of the impact printing device 22. FIG. 4 illustrates a side view of the positioner within a working environment. In the preferred embodiment, the print disk positioner includes a DC stepping motor 38 having a shaft 40 and a pinion gear 42. The motor is rigidly affixed to a rail member 44 by means of fasteners 46. Rail 44 itself is affixed to a housing 48 which supports the rail on an incline plane, preferably on three sides, the back and two sides. Housing 48 is then affixed to a base plate 50 on which an overall machine may be mounted. Motor 38 is spaced apart from rail 44 by spacer 52 so that pinion gear 42 does not rub against the rail.

A second DC stepping motor 54 is slideably affixed to rail 44. This is accomplished by the combination of 4 roller bearings 56 each having a lip 58 sandwiched between the top of the motor and a retaining plate 60 and held by means of fasteners 62. Rail 44 includes a portion on the top surface thereof which has a groove 64 which extends from the outer edge thereof on both sides. Lip 58 is sized to be received within groove 64, and the motor can track along the rail in the longitudinal direction. A plate spring 65 put a bias between motor 54 and rail 44 to dampen vibrations and fix the spacing between these members.

Motor 54 includes a shaft 66 which extends through a slot 68 in the rail surface. Shaft 66 may be fitted with a mounting ring 70 which has a key 72 to be received within hole 30 and key way 32 respectively on the print disk. Under ring 70 is a supporting mandril 69 which is a flat disk of sufficient diameter to provide rigid and accurate support for the print disk. A knob 71 can be screwed onto the shaft not visible to apply pressure between ring 70 and the knob and maintain the print disk rigidly affized to the shaft.

Figure 5:
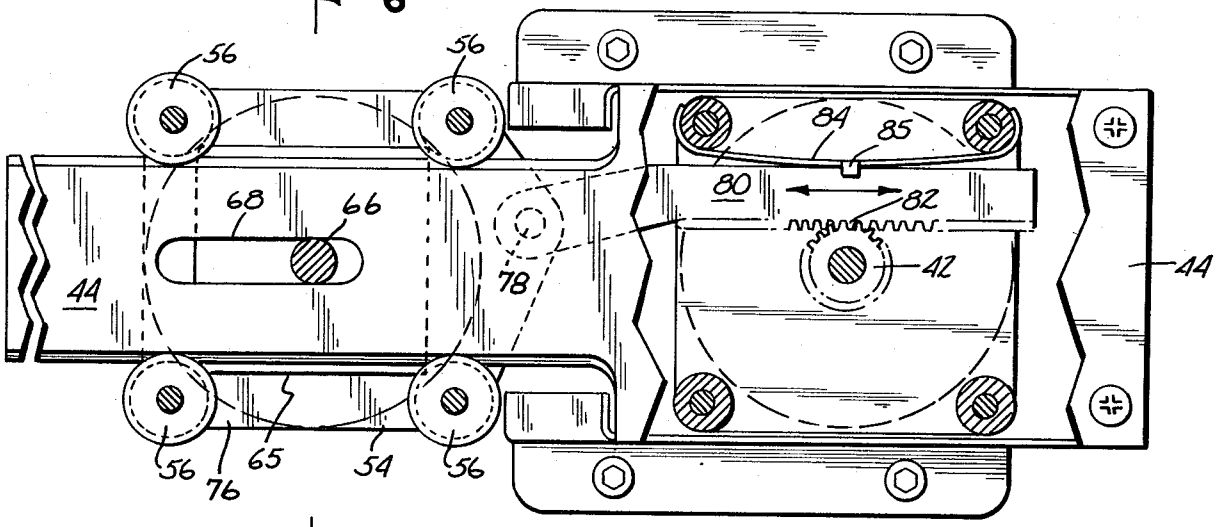
FIG. 5 is a view like FIG. 3 with portions of the rail member broken away to enhance visibility of the parts thereunder.
Figure 6:
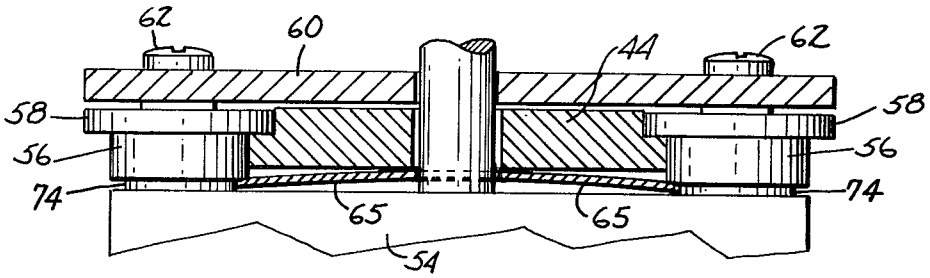
FIG. 6 is a view taken along line 6—6 of FIG. 5.

Bearings 56 are kept spaced from motor 54 by spacers 74 and a spacer plate 76. The spacer plate includes an aperture 78. Attached to the spacer plate at the aperture 78 by a fastener (not shown) is a rack arm 80 which extends toward pinion 42 and has teeth 82 which engage the pinion gear 42. Extending between spacers 52, on one side, is a spring 84 (see FIG. 5) preferably made of phosphor bronze which extends around spacers 52 and follows a slightly curved path as it biases against rack arm 80 which, in turn, is biased into teeth 82 on the pinion gear. Spring 84 preferably includes a pair of ears 85 which engage either side of rack arm 80 to maintain the position of the various parts.

A sensor 67 (FIG. 4) is located on the support frame for the motor 38 and has a gap (not shown) which receives a planar member 69 affixed to motor 54. The purpose of these elements is to provide electrical sensing information when the motor 54 is in its upper most position along the track, i.e. motors 54 and 38 most proximate each other. This is considered "the start" position of the machine. Sensor 67 may include a photo diode and light source which would detect the interposition of the opaque element 69. Electrical information from sensor 67 is used to position the disk for reading of the bar code 33. This code is read by sensor 73 affixed to the top of rail 44. Sensor 73 may include a photo diode and light source positioned at an acute angle, such as 45 degrees so that the bar code is illuminated by the light source and picked up by the adjacent photo diode.

Returning to the print disk, it can be seen that there are three concentric rings of printing characters, although a larger or smaller number of rings could also be employed. The location of the letters, upper case and lower case, and symbols has been chosen so that their frequency is most closely related to the "home" position adjacent keyway 32. Thus, on the average, the printwheel will be moved a minimum rotational and radial distance for typing standard English. Of course, a different arrangement of letters and symbols would be required for different languages and, indeed, different dialects.

Each character is located within its concentric ring in accordance with the maximum number of steps (increments) of the stepping motor. In this embodiment, the motor as a 200 step circle at 1.8 degrees per step. That permits 40 characters in the first row, 33 in the second row and 28 in the innermost row. In the inner two rows, there will be spaces that are unusable since the quotient of such division is not a round number. The proposed radius of the disk is 9.15 centimeters.

The disk is preferably black in color except for the bar code region 31 which is light. The bars are also preferably black. Leading edge **31*a* and trailing edge 31*b* of the bar code region can thereby be easily detected by sensor 73 and the leading edge 31*a*** can be used as the "home" position, so that the letter "E" is at "home".

OPERATION OF THE INVENTION

DC stepping motor 38 controls the lateral movement of the print disk with respect to its engagement within the jaws of the impact printing device 22. Rotation of the pinion gear in one direction causes the rack 80 to force motor 54 along the rail on bearings 56. A reverse rotation has the opposite effect. Stepping motor 54 controls the rotation of the print wheel. The combination of controlled movements for motors 38 and 54 can position the print disk at any desired location within the impact printing device. Control of DC stepping motors is well known in the art, and computer or electromechanical control may be provided to align the print wheel at the necessary locations in a desired sequence to produce words and sentences when the print disk is impacted by device 22 (FIG. 1).

Various advantages and features of novelty which characterize the invention are pointed out with particularity in the claims annexed hereto and forming a part hereof. However, for a better understanding of the invention, the advantages and objects obtained by its use, reference should be had to the drawings which form a further part hereof and to the accompanying descriptive matter in which there are illustrated and described certain preferred embodiments of the invention.

We claim:

1. A print disk positioner for use in an impact printer employing a disk having characters thereon to be printed comprising:

(a) a planar rail member having first and second ends and a slot therethrough extending a predetermined distance between the ends, (b) a first electric stepping motor attached to said rail toward one end thereof and having a shaft with a pinion gear extending out of said motor, (c) a second electric stepping motor having a plurality of bearings attached thereto and in slideable engagement with said rail, said second motor having a second shaft extending therefrom through said slot to the other side of said rail to receive the print disk, (d) a connecting arm with rack teeth affixed to said second motor at one end and engaging said pinion gear for moving said second motor up and down said rail in response to rotation of said first shaft; and (e) means biasing said rack into engagement with said pinion gear.

2. A positioner according to claim 1 wherein said biasing means includes a curved band of resilient material affixed at its ends to said first motor.

3. A positioner according to claim 1 wherein said rail has two parallel longitudinal edges between recess therein extending a predetermined distance between the ends, and wherein said bearings include a lip located and sized to be received within said recess, so that said motor is rigidly attached to said rail.

4. A print disk positioner according to claim 1 including sensor means located on said rail and adjacent said second shaft for detecting coded information on the print disk, so that the type style and point size of characters on the disk can be determined.

5. A print disk according to claim 1 wherein said rail is mounted on a support which locates the rail in an inclined plane.

6. A positioner according to claim 4 including a second sensor operatively connected to planar rail and a flange member operatively connected to said second stepping motor, said sensor and flange being located such that said sensor can detect the position of said second motor when the disk is fully withdrawn from the impact printer.

7. A print disk for use in an impact printing machine comprising at least 3 concentric bands of spaced raised characters, the height of each character being adjusted to proportionally adjust the impact pressure applied thereon.

8. A print disk in accordance with claim 7 wherein the characters are arranged such that the most frequently used characters surround a predetermined "home" position on the disk.

* * * * *